US011591794B2

(12) United States Patent
Piccone

(10) Patent No.: US 11,591,794 B2
(45) Date of Patent: Feb. 28, 2023

(54) STAY-IN-PLACE READY-TO-STUCCO FORMWORK SYSTEM

(71) Applicant: Piccone Holdings Ltd., Vancouver (CA)

(72) Inventor: Franco Piccone, Vancouver (CA)

(73) Assignee: Piccone Holdings Ltd.

( * ) Notice: Subject to any disclaimer, the term of this patent is extended or adjusted under 35 U.S.C. 154(b) by 156 days.

(21) Appl. No.: 16/763,534

(22) PCT Filed: Nov. 9, 2018

(86) PCT No.: PCT/CA2018/051423
§ 371 (c)(1),
(2) Date: May 12, 2020

(87) PCT Pub. No.: WO2019/095048
PCT Pub. Date: May 23, 2019

(65) Prior Publication Data

US 2020/0362560 A1 Nov. 19, 2020

(30) Foreign Application Priority Data

Nov. 14, 2017 (CA) ..... 2985420

(51) Int. Cl.
*E04B 2/86* (2006.01)
*E04B 2/84* (2006.01)

(52) U.S. Cl.
CPC ..... *E04B 2/8652* (2013.01); *E04B 2/847* (2013.01); *E04B 2/8635* (2013.01)

(58) Field of Classification Search
CPC ..... E04B 9/065; E04B 9/8635; E04B 9/8658; E04B 9/8641; E04B 9/845; E04B 9/8652;
(Continued)

(56) References Cited

U.S. PATENT DOCUMENTS 2,251,499 A * 8/1941 Pelton ..... E04B 2/86 249/35
3,395,506 A * 8/1968 Petrig ..... E04B 2/845 52/579
(Continued)

FOREIGN PATENT DOCUMENTS

CA 2175930 A1 5/1995
CA 2111801 A1 6/1995
(Continued)

OTHER PUBLICATIONS

International Search Report and Written Opinion for International Application No. PCT/CA2018/051423, dated Feb. 6, 2019,14 pages.

*Primary Examiner* — Jessica L Laux
(74) *Attorney, Agent, or Firm* — Stoel Rives LLP

(57) ABSTRACT

A stay-in-place concrete formwork system allows stucco to be applied directly to the formwork, avoiding the need to provide a further surface treatment of the wall prior to applying stucco. Apertures are provided on an exterior facing wall of the formwork panel to receive and embed stucco therein. The panel may also be formed with outward stucco-engaging projections. Other features include using rigid insulation to brace the stucco and keep concrete from the apertures, a sealing joint element, extendible panels for use in curved formwork, rainscreen features and an alligator connector panel for adjustable lengths of formwork faces.

9 Claims, 20 Drawing Sheets

(58) Field of Classification Search
CPC ..... E04B 9/847; E04B 9/86; E04B 9/8611; E04B 9/8605; E04G 11/00; E04G 9/10; E04F 13/045
See application file for complete search history.

(56) References Cited

U.S. PATENT DOCUMENTS

| | | | | |
|---|---|---|---|---|
| 9,850,658 | B2 * | 12/2017 | Alcala Ordaz | E04B 2/8635 |
| 9,982,444 | B2 * | 5/2018 | Richardson | E04G 17/005 |
| 2015/0275531 | A1 * | 10/2015 | Alcala Ordaz | E04B 2/8635 249/189 |
| 2017/0175407 | A1 * | 6/2017 | Richardson | E04G 17/00 |

FOREIGN PATENT DOCUMENTS

| | | | |
|---|---|---|---|
| CA | 2594374 | A1 | 8/2001 |
| CA | 2329358 | A1 | 6/2002 |
| CA | 2502392 | A1 | 5/2004 |
| CA | 2930366 | A1 | 11/2016 |
| WO | 199512790 | A1 | 5/1995 |
| WO | 2004038118 | A1 | 5/2004 |

* cited by examiner

STAY-IN-PLACE READY-TO-STUCCO FORMWORK SYSTEM

FIELD OF THE INVENTION

This invention relates to modular formwork systems. More specifically, this invention relates to stay-in-place modular formwork systems.

BACKGROUND OF THE INVENTION

It is known to provide concrete formwork comprising modular inter-connectable panels that stay in place after the concrete has set. Canadian Patent No. 2,226,497 exemplifies such a modular inter-connectable formwork system.

Stucco can be applied to such structures by then securing a mesh to the outside of the wall, with the stucco being applied to the mesh in the conventional manner. Any insulation is typically placed on the inside surface of the concrete wall after the concrete has set.

SUMMARY OF THE INVENTION

The present invention provides a stay-in-place concrete wall formwork system that allows stucco to be applied directly to the formwork, avoiding the need to provide a further surface treatment of the wall prior to applying stucco. The panels may include mating engaging means for attaching transverse connectors to retain opposed faces of the formwork in spaced relationship to assist in withstanding the outward pressure of the concrete on the panels.

In one aspect, modular panels adapted to be interconnected to other formwork panels to form stay-in-place concrete formwork include apertures substantially throughout the substantially planar surface of the panel for receiving stucco through the apertures. The modular panel is an outward-facing wall panel of the formwork and the apertured planar surface is outwardly facing.

The panel preferably comprises a plurality of projections extending inwardly from said planar surface.

The formwork is formed by first installing rigid foam insulation against the inside of the apertured panel prior to pouring concrete into the formwork. The stay-in-place formwork is assembled, the rigid insulation is installed against the projections, concrete is poured into the formwork and stucco is applied to the outside of the aperture surface of the panels so that the stucco embeds into the apertures.

In another embodiment, a modular interconnectable saty-in-place formwork panel is double walled with a space between the two walls. The outward facing wall is substantially planar and comprises a plurality of stucco-receiving apertures substantially throughout the surface.

In another aspect, a panel is provided with stucco engagement protrusions about the outside surface of the panel. In one embodiment, the protrusions are trapezoid in shape.

In another aspect, a panel is a double-walled panel, the outside facing wall of the panel being apertured to receive stucco. Use of this embodiment avoids the need to provide a barrier by installing rigid foam insulation prior to pouring the concrete.

In another aspect, an outwardly extending sealing stub is provided on a three-way joint piece or element that attaches side by side adjacent face or wall panels to each other and to a transverse connector. The sealing stub has an enlarged tip and extends between adjacent edges of the face panels for engagement of the tip to the adjacent edges when concrete applies pressure to the panels. The pressure of the concrete on the wall panels in conjunction with the restraint provided by the transverse connector act to seal the adjacent edges of the wall panels against the sealing stub to make the joint fluid and gas impermeable.

A modular stay-in-place concrete formwork system comprising modular interconnectable face panels maintained in opposed spaced relationship by modular transverse connectors, and three-way joining elements each of said three-way joining elements being adapted to retain two side by side adjacent face panels to one another and to one of said transverse connectors, each of said joining elements comprising a stub extending between.

In another aspect, an extendible or compressible panel is provided to accommodate curved formwork by providing a vertically extending pliable segment in the wall panel. The pliable segment is formed as a discontinuity in the otherwise substantially planar surface of the panel. The pliable segment may be of a material that is resiliently pliable as compared to the material forming the balance of the panel.

In another aspect, a rain screen capability is built into the formwork system by providing rigid foam insulation that includes a vertical cutout providing a space surrounding engagement members on the transverse connector of the formwork. The cutout provides a channel for drainage of any moisture that might migrate inward along a transverse connector. In an alternative, a space is provided between adjacent layers of rigid foam insulation, the space corresponding to the location of engagement members on the transverse connectors.

In another embodiment, the transverse connectors of the modular stay-in-place concrete formwork system include engagement members extending laterally from the connectors and the engagement members have stems with a spike or spikes for engaging into rigid insulation to be installed within the formwork.

The foregoing is only a broad summary of some aspects of the inventive features, and is not intended to formally delimit the invention. Not all of the features summarized above are necessarily met by all of the embodiments described below or by the invention defined by each of the claims.

BRIEF DESCRIPTION OF THE DRAWINGS

The preferred and alternative embodiments of the invention will be described by reference to the drawings thereof in which.

DETAILED DESCRIPTION OF THE EMBODIMENTS

Figure 1:
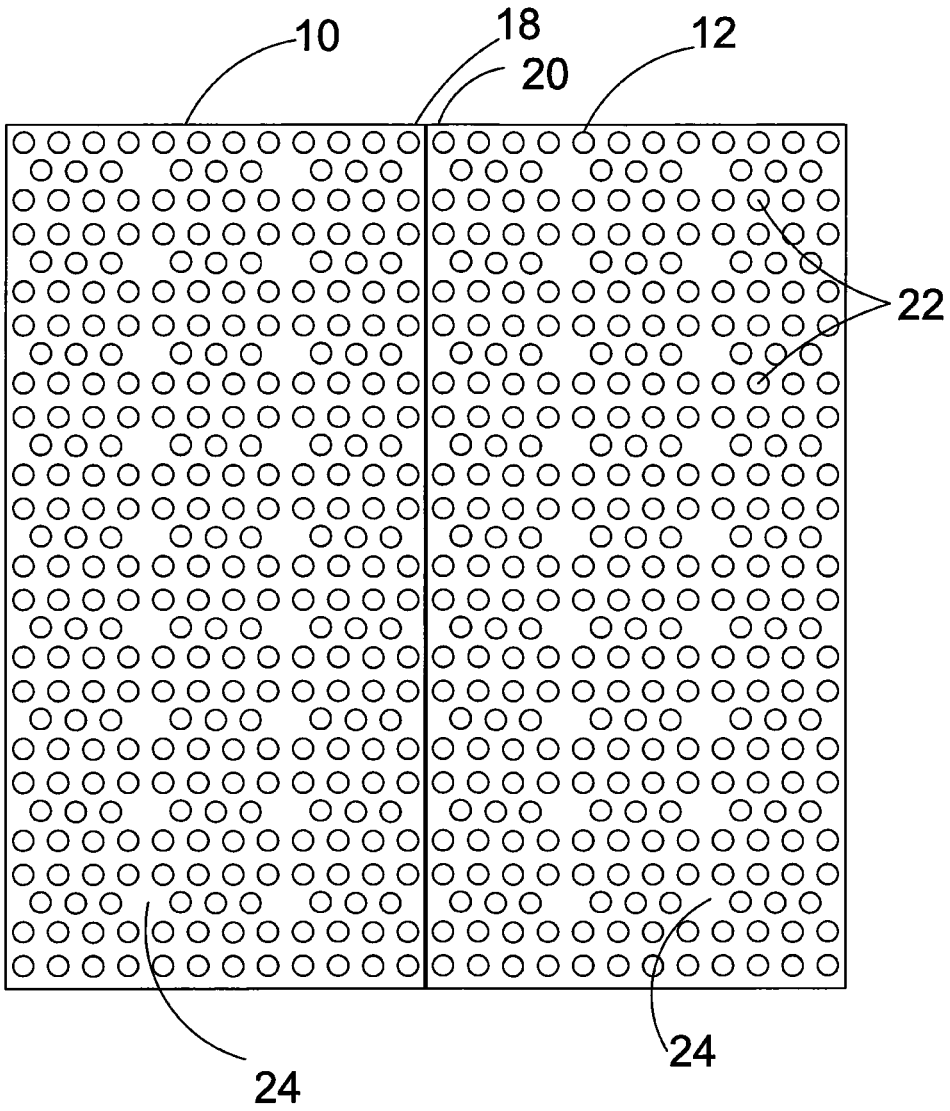
FIG. 1 is a face view of two interconnected formwork panels according to the preferred embodiment of the invention.
Figure 2:
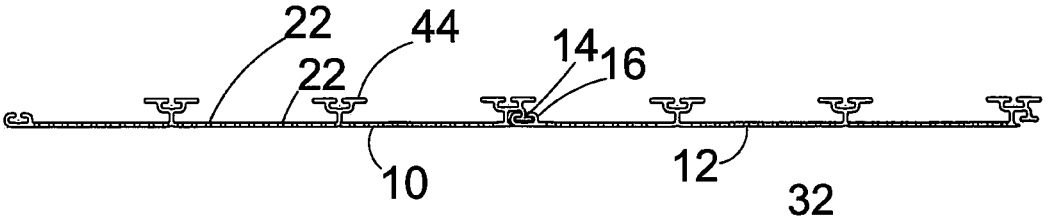
FIG. 2 is an edge view of FIG. 1.

FIG. 1 illustrates two inter-connected formwork panels 10 and 12 according to a preferred embodiment. The panels are connected by engagement of male 14 and female 16 (cf. FIG. 2) interfaces extending along the respective edges 18, 20 of the panels 10, 12.

A plurality of apertures 22 are formed about substantially the entirety of the faces 24 of the panels 10, 12 as illustrated in FIG. 1.

Figure 3:
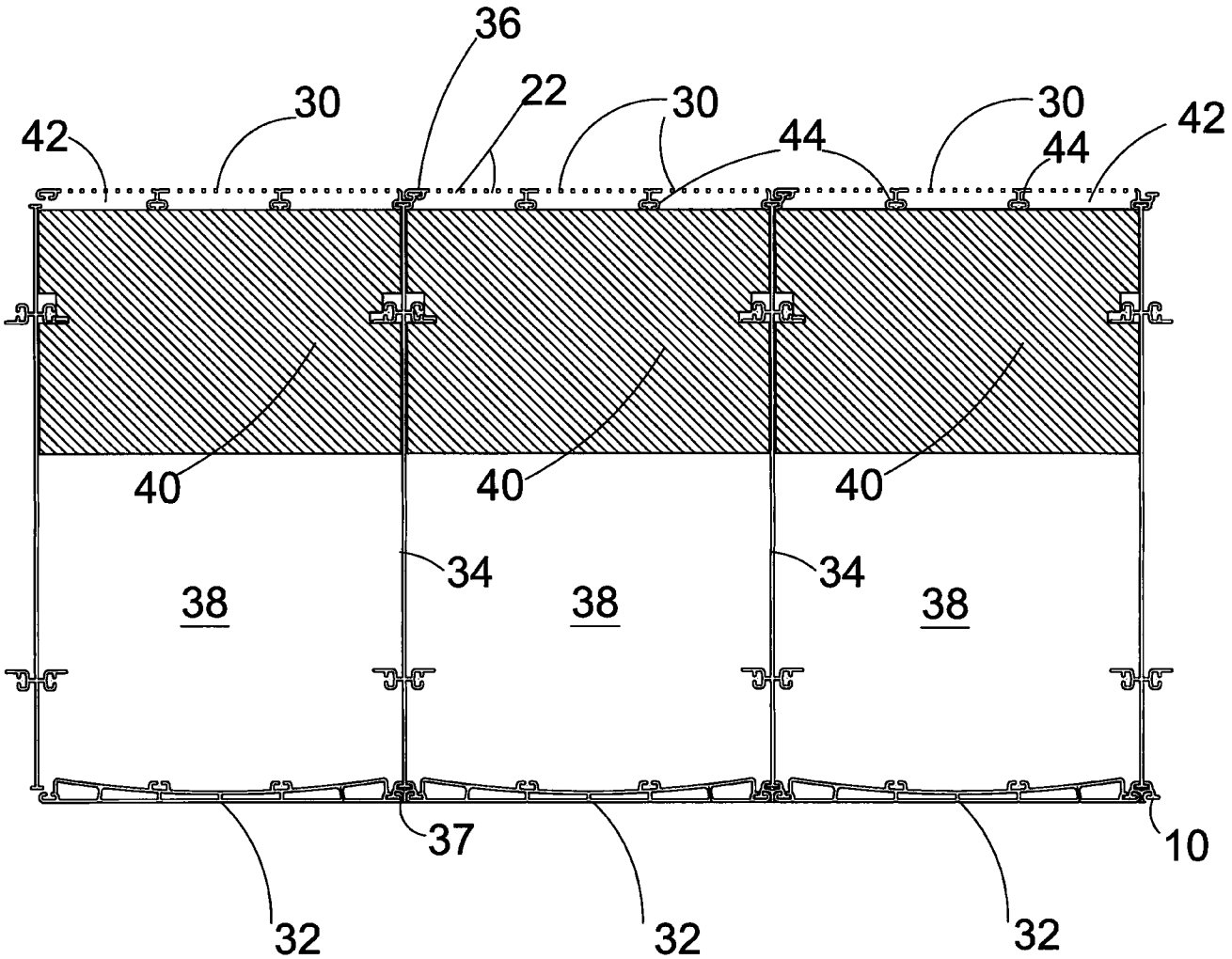
FIG. 3 is a top view of formwork including insulation placed therein according to the preferred embodiment.

In one embodiment, one side of the formwork is made of single walled panels 30 shown in FIG. 3. The single walled panels 30 are spaced from opposing panels 32. Although panels 32 are shown in FIG. 3 as double-walled, they may also be single-walled. Panels 30 and 32 are connected by transverse connectors 34 that are inserted along mating elements 36, 37 which mating elements 36, 37 preferably act as three-way connectors to retain side to side adjacent wall panels as well as to connect the wall panels to the transvers connectors 34. Concrete is to be poured into the space 38 between the panels 30 and 32.

When using single walled panels with apertures 22 according to the invention, a method for using the panels comprises placing rigid insulation 40 against the inside surface of the panels 30 to which stucco may then be applied through the apertures 22 on the outside surface, and placing such insulation 40 prior to pouring the concrete into the form. The rigid insulation provides a barrier to prevent the concrete from filling the apertures 22. A gap 42 is provided between the insulation 40 and the formwork panel 30 by virtue of the standoff created by the inwardly projecting mating elements 44 of the panels 30. The inwardly projecting mating elements 44 are available to be used with additional connectors 34 or with diagonal (45 degree) connectors of the type shown in FIGS. 10 and 12. Stucco may then be applied directly to the outside surface of the panels 30 so that some of the stucco flows through the apertures 22 to embed the stucco in the panels 30. The use of the rigid insulation 40 prior to pouring the concrete prevents the concrete from extruding out of the panel apertures, which would defeat the purpose of the apertures in later receiving the stucco.

Figure 3A:
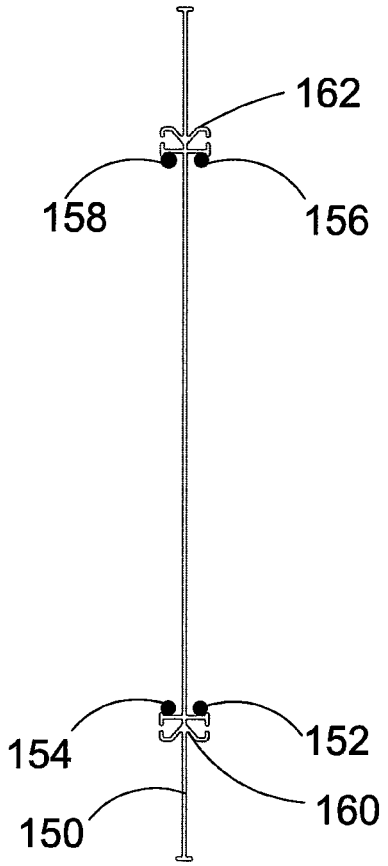
FIG. 3A is a top view of an alternative connector for providing enhanced structural rigidity to the resulting wall.

In order to enhance the structural rigidity of the modular formwork system, and therefore the resulting wall, an embodiment 150 of the connector is provided with reinforcing ribs 152, 154, 156, 158 along the length of the connector as shown in FIG. 3A. The ribs may be located at a variety of locations on the connector so as to enhance the structural rigidity of the modular formwork system. In the alternative embodiment illustrated in FIG. 3A the ribs are positioned on the mating elements 160, 160.

Figure 4:
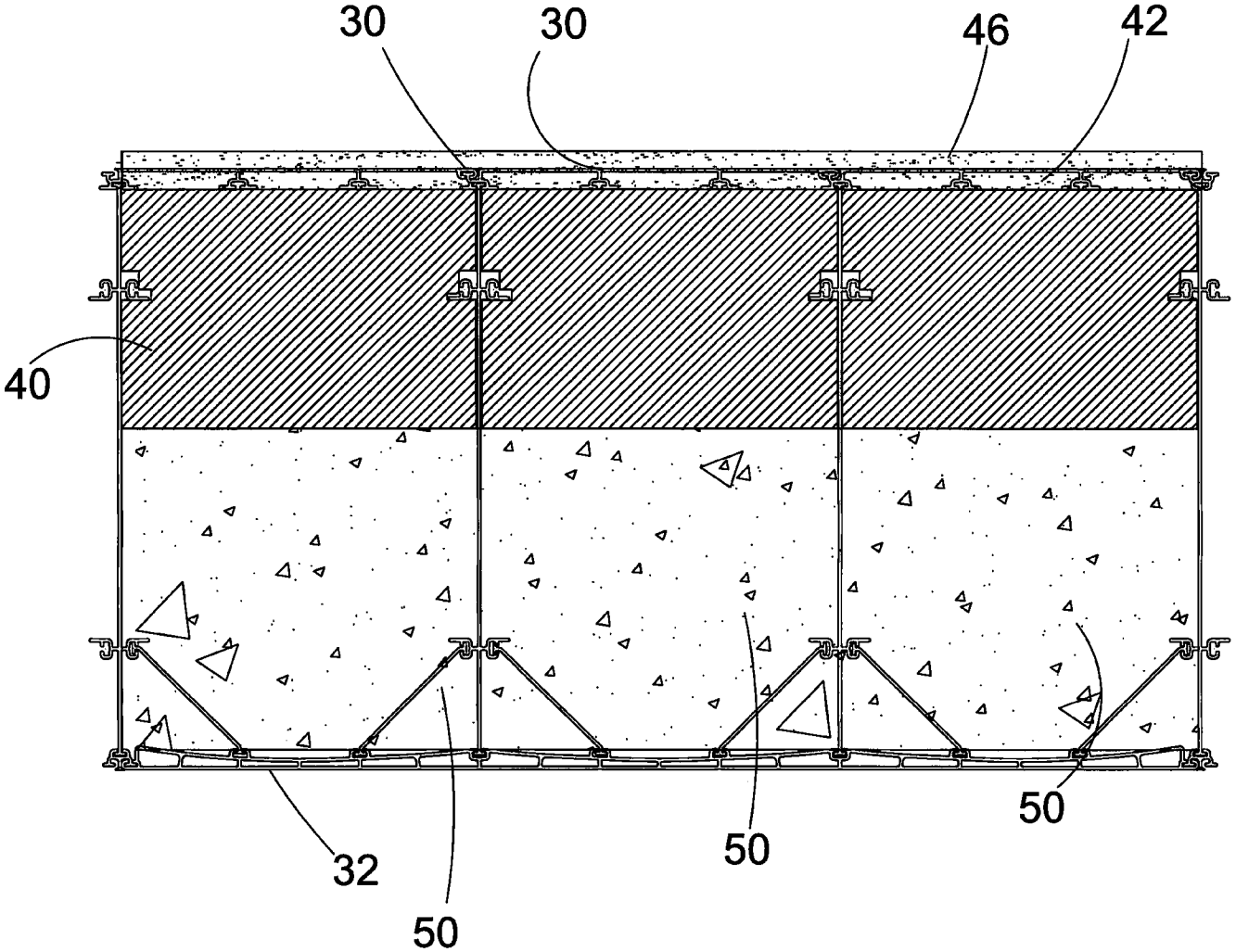
FIG. 4 is a top view of formwork including insulation and concrete and further including stucco applied to and through the exterior panels according to the invention.

FIG. 4 shows the system of FIG. 3 with concrete 50 having been poured into the formwork and stucco 46 having been applied to the exterior panels 30 and through the apertures in the panel 30 and into the gap 42 behind the panel 30.

Figure 5:
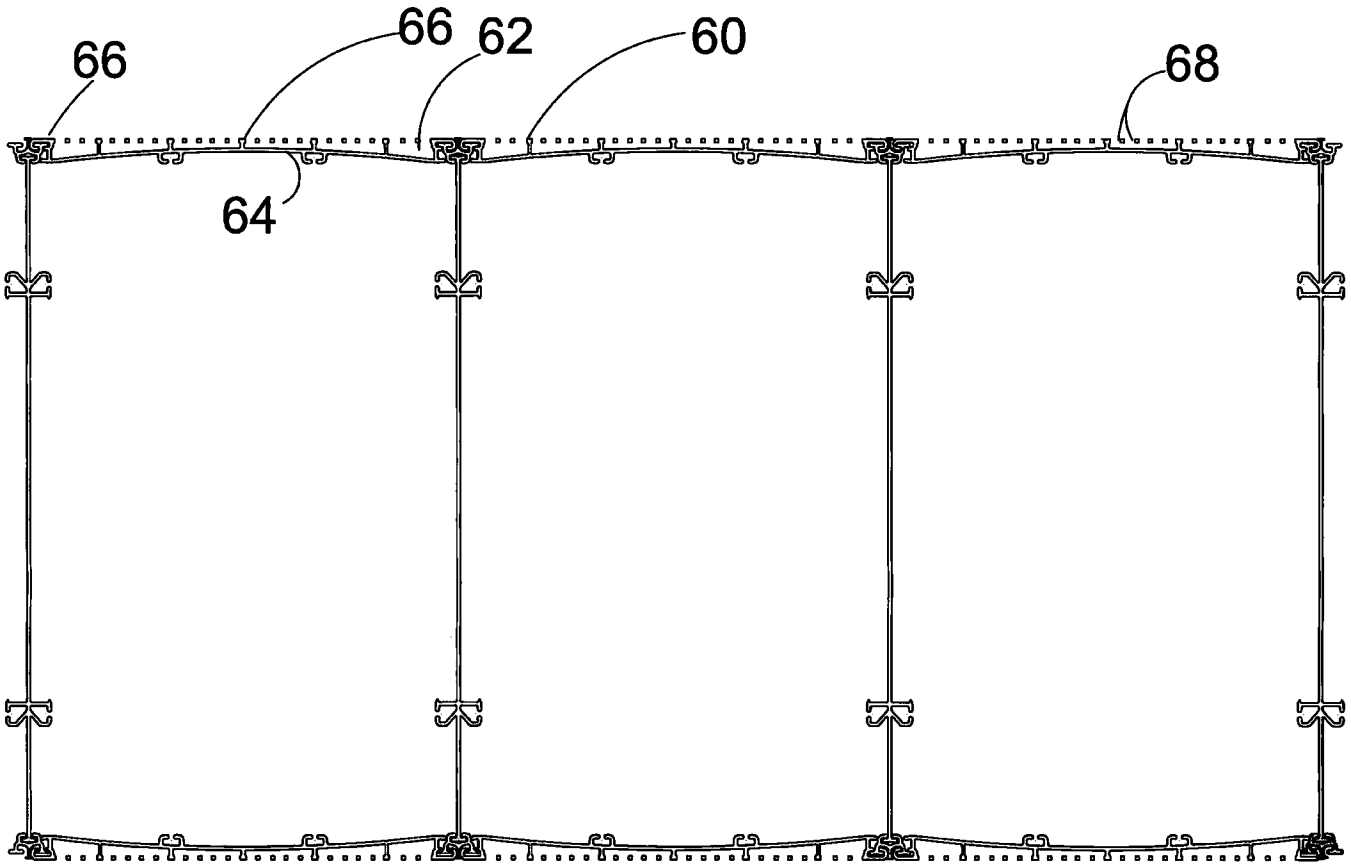
FIG. 5 is a top view of formwork comprising double-walled panels with stucco-receiving apertures according to an embodiment.

In another embodiment, the formwork panels 60 forming the exterior facing side of the formwork are double-walled, as shown in FIG. 5, with a space 62 between the walls 64, 66 of each panel, allowing for penetration of the stucco into the space 62. In such embodiment, at least the outer wall 66 comprises apertures 68 for embedment of the stucco. Part of the stucco flows through the apertures 68 into the interstitial space 62 between the panel walls 64, 66.

Figure 6:
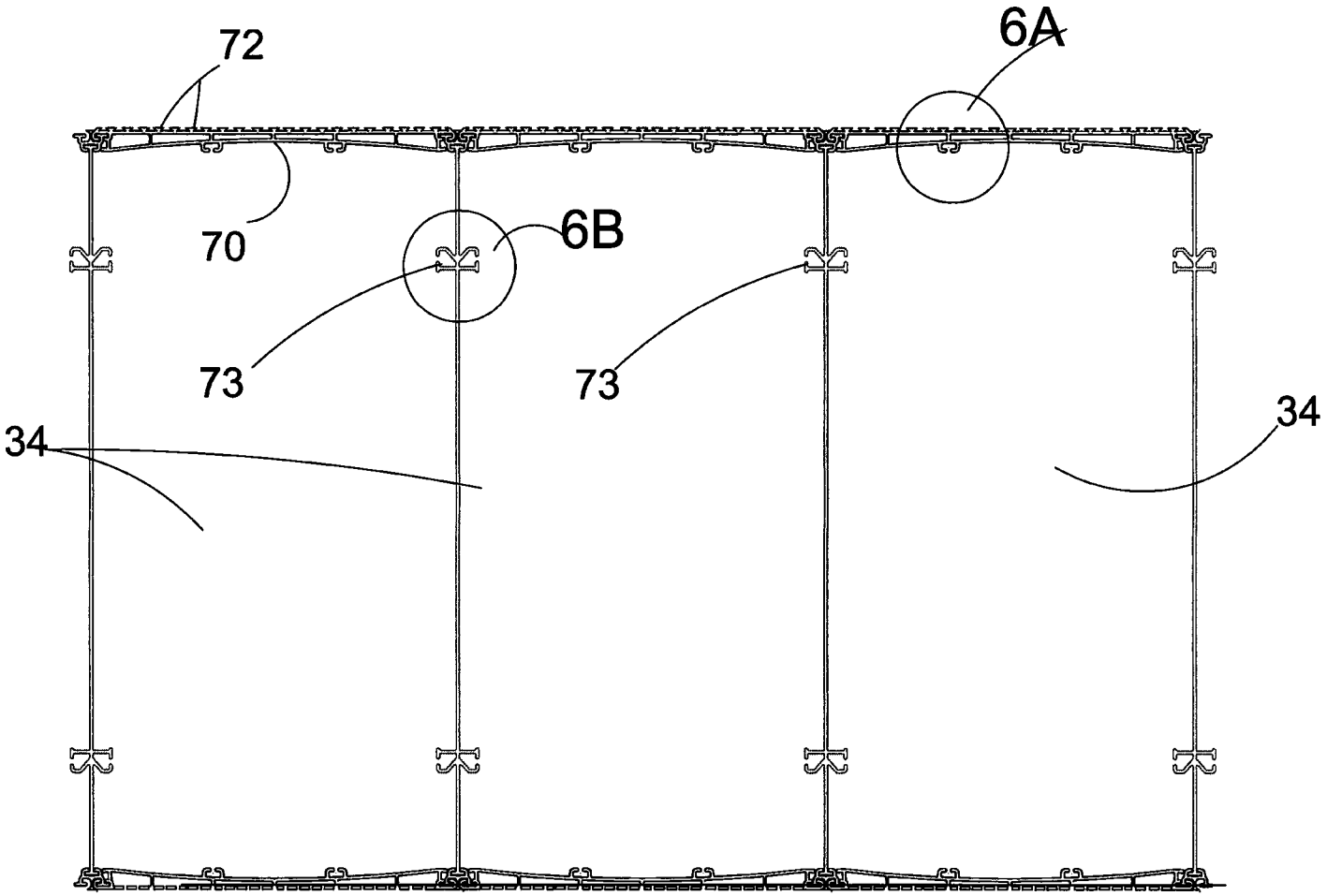
FIG. 6 is a top view of formwork comprising panels that include outward projections for retaining stucco.
Figure 6A:
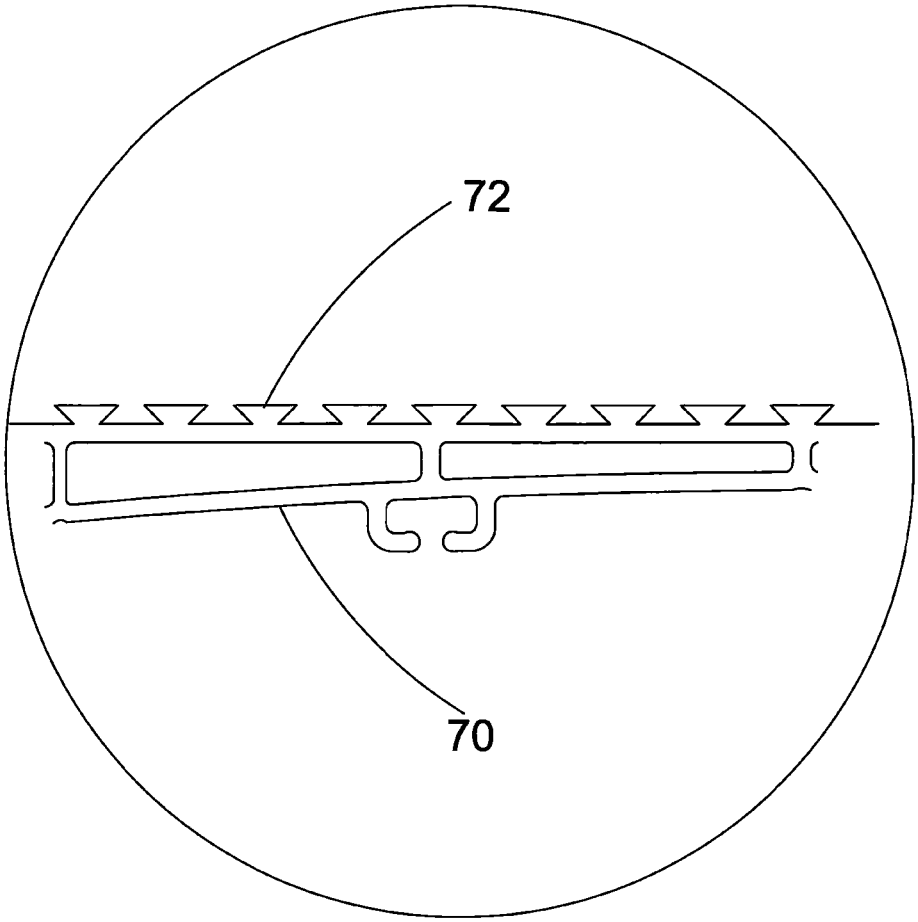
FIG. 6A is an enlarged view of circle 6A of FIG. 6.

In a different embodiment, illustrated in FIG. 6, the panel 70, which may be single walled, or double walled as shown in FIG. 6, comprises outwardly extending protrusions 72 substantially across the face of the panel, instead of (or in addition to) apertures. The shape of the protrusions 72 may be such as to trap the stucco between the protrusions. The trapezoid shape of projection 72 that is more clearly shown in FIG. 6A is an example of a shape that is suitable.

Figure 6B:
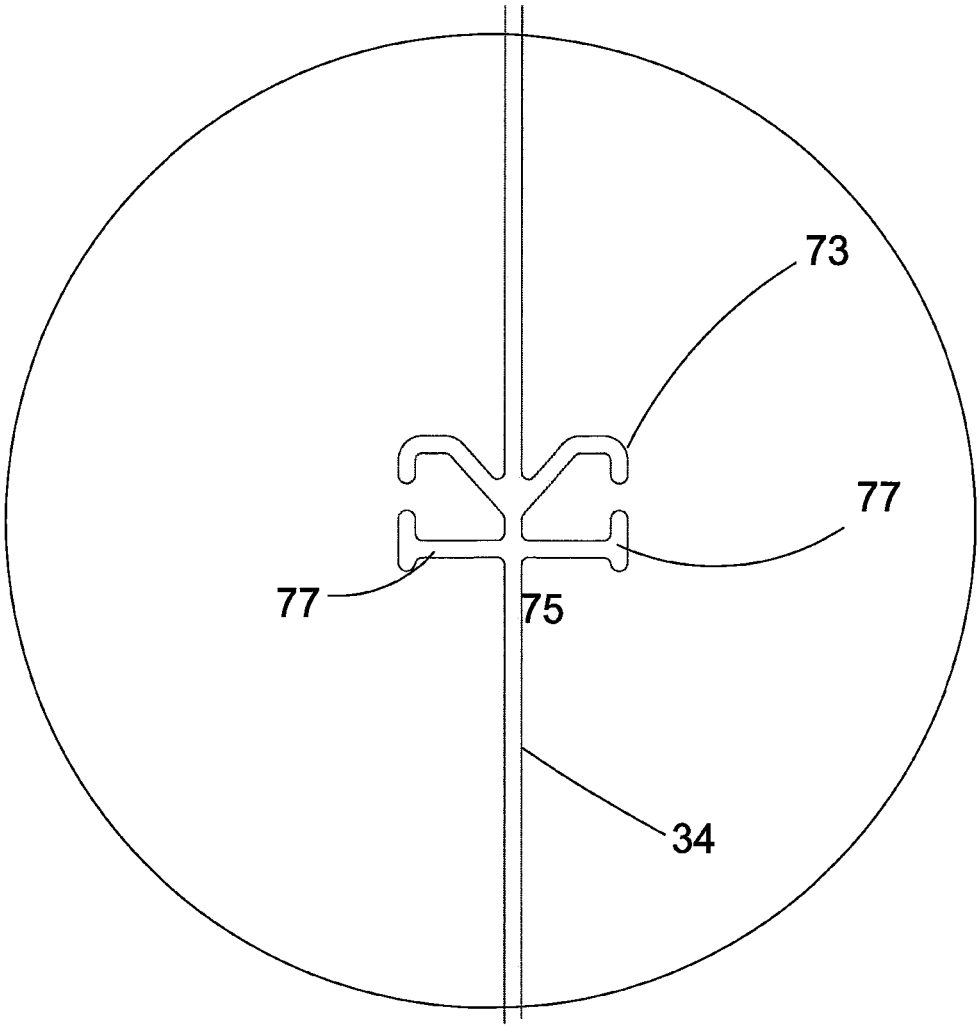
FIG. 6B is an enlarged view of circle 6B of FIG. 6.

Another feature illustrated in FIG. 6 is the use of mating elements 73 on transverse connectors 34, better illustrated in the enlarged view of FIG. 6B, that include stems 75 having spikes 77. The stems 75 are transverse to the connector 34 so as to jut toward the insulation that is intended to be installed in the formwork. The spikes 77 assist in embedding the insulation into the connector 34 thereby providing a more secure installation of the insulation.

Figure 7:
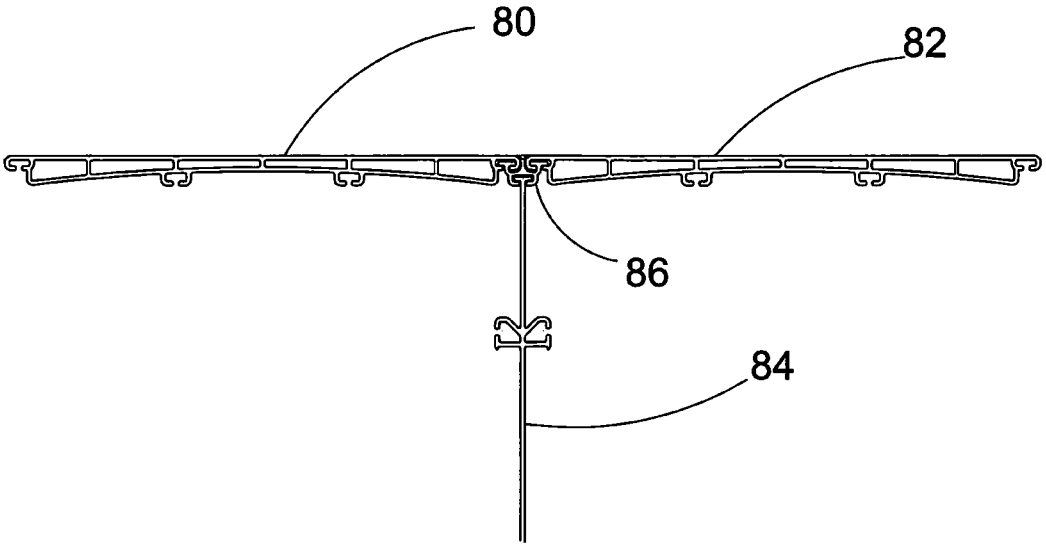
FIG. 7 is a top view of a portion of formwork and a joint between adjacent wall panels and a connector panel showing a sealing connector joint according to an embodiment.

A different aspect of an inventive system relates again to modular inter-connectable formwork elements intended to stay-in-place after concrete is poured into the formwork and has set. It is desirable in some cases to have air and fluid-tight formwork that is impermeable not only to concrete but to gases and low viscosity fluids. The modular system to which the invention relates is a system that includes side to side adjacent connectable wall panels 80, 82, which may be double-walled as shown in FIG. 7 or single-walled. Modular connectors 84 span between opposed panels to retain them in spaced relation, thereby forming an inter-panel space that receives the concrete, as suggested by FIG. 5 for example. Referring again to FIG. 7, the connector panel 84 may mate with a three direction joining element 86 that is used to connect side to side adjacent wall panels 80, 82 along with connector panel 84. The joining element 86 may alternatively be formed integrally with connector panel 84.

Figure 8:
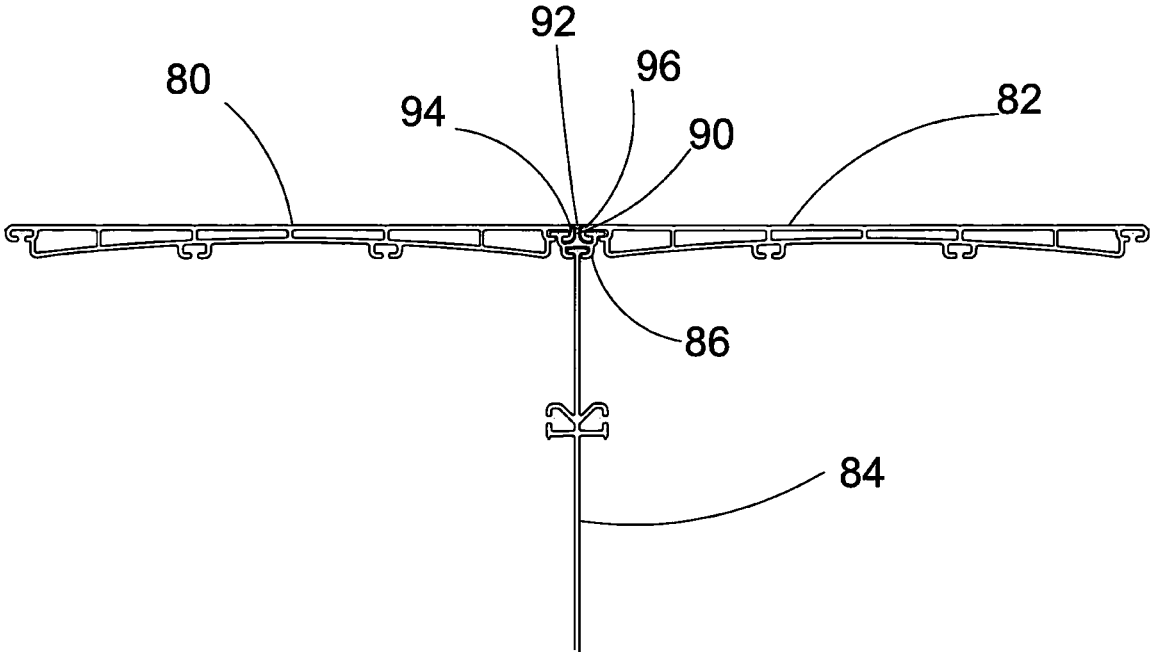
FIG. 8 is a close up view of the joint shown in FIG. 7.

Referring to the enlarged view in FIG. 8, the invention comprises a stub 90 that extends from a joining element 86 used to connect two adjacent panels 80, 82 and to also connect a transverse connector 84 to opposed panels (not shown in FIG. 9) forming the formwork. The stub 90 has an enlarged tip 92 at the outside end of the joining element 86. As the poured concrete pushes the panels 80, 82 outward, the joining element 86 is not pushed outward as it restrained by the transverse connector 84. As a result, the contiguous ends 94, 96 of adjacent panels 80, 82 are pushed outward and angled slightly in relation to the joining element 84 (and therefore in relation to the enlarged tip 92), thereby sealing the joint between the tip 92 and the ends 94, 96. The sealing effect can be enhanced by making the tip 92 resilient or soft so that it can create an effective seal against the ends 94, 96.

Figure 8A:
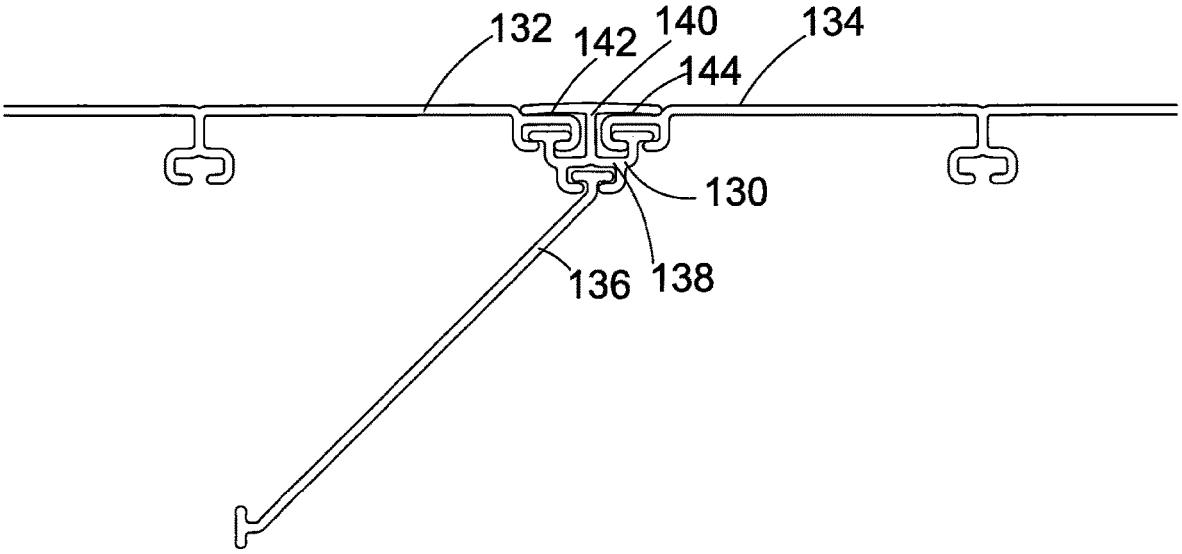
FIG. 8A is a plan view of an alternative embodiment of a joining element for providing a sealed joint between panels.

FIG. 8A is a plan view of an alternative embodiment of a joining element (130) connecting two adjacent panels 132, 134 and a transverse or diagonal connector 136. The alternative embodiment of the joining element comprises a connector body 138 and a T-shaped portion 140 made of substantially the same material as the body 138, but further comprising two ribs 142, 144 on the opposed arms 146, 148 of the "T". The ribs 142, 144 are of a softer resilient material so as to effect a seal between the exterior and the interior of the modular formwork assembly. The continuous opposed arms 146, 148 of the T portion 140 are preferably formed with a slight inward curvature at the tips when unstressed, which curvature straightens when the joining element 130 is urged inward by the connector 136 to apply pressure to the two ribs. As a result, the arms 146, 148 become straight and present a continuous surface flush with the outside wall of the formwork, while also providing an effective seal by means of the ribs 142, 144.

Where a modular panel formwork system is used for a curved wall, an issue arises as to the difference in arc lengths between the outward facing panels of the formwork and the inward facing panels for the same arc angle. The panels on the inside of the curve will have a shorter length than those on the outside of the curve. One means of resolving that problem in a modular system is to predetermine the different lengths that will be needed based on the radii of curvature involved and manufacturing or selecting modular panels lengths accordingly. It will be appreciated however that precise tolerances are required. In some cases, spacers may be used intermittently along the outside wall of the formwork to make up for the extra length needed in comparison to the inner wall. The differences in length involved in concrete walls are often fairly small. For example, a concrete tank having an exterior diameter of 40 meters and a concrete wall formwork thickness of 30 cm would involve an overall circumference difference of only 0.9 meter as between the interior and exterior runs of panels. That difference translates to only about 7 mm per meter of circumference.

Figure 9:
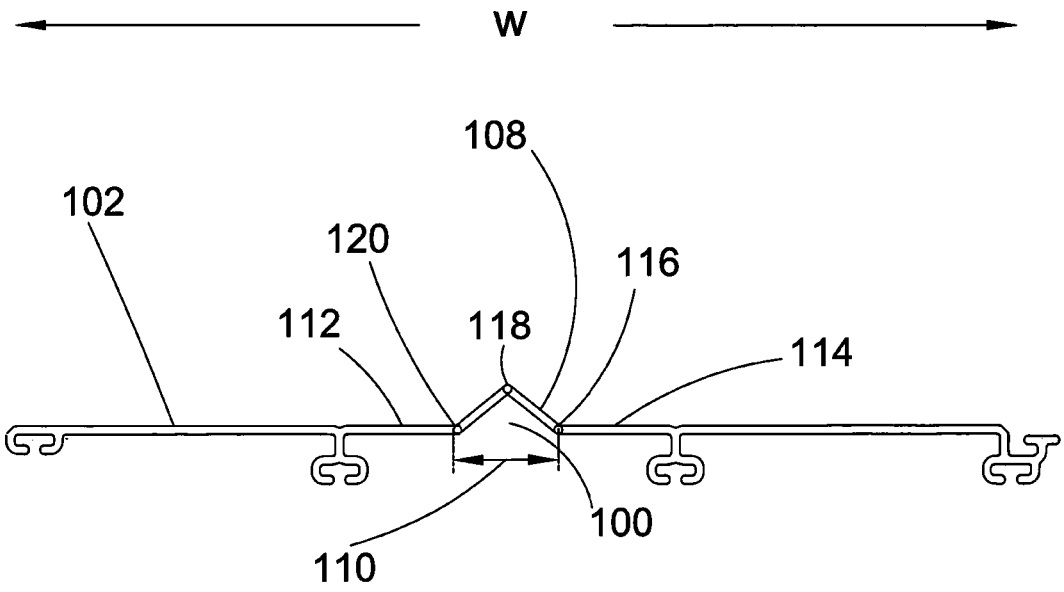
FIG. 9 is an edge view of an extendible panel according to an embodiment.

According to an embodiment designed to address that problem, a modular inter-connectable formwork panel includes at least one non-straight pliable segment along the span of each otherwise substantially unextendible panel, rendering the panel extendible by stretching or compressing the pliable segment. Referring to FIG. 9, the pliable segment 108 may comprise a V-shaped notch 100 extending in the intended vertical orientation of the panel 102. Substantially the balance of panel 102 is not made of pliable portions.

Figure 10:
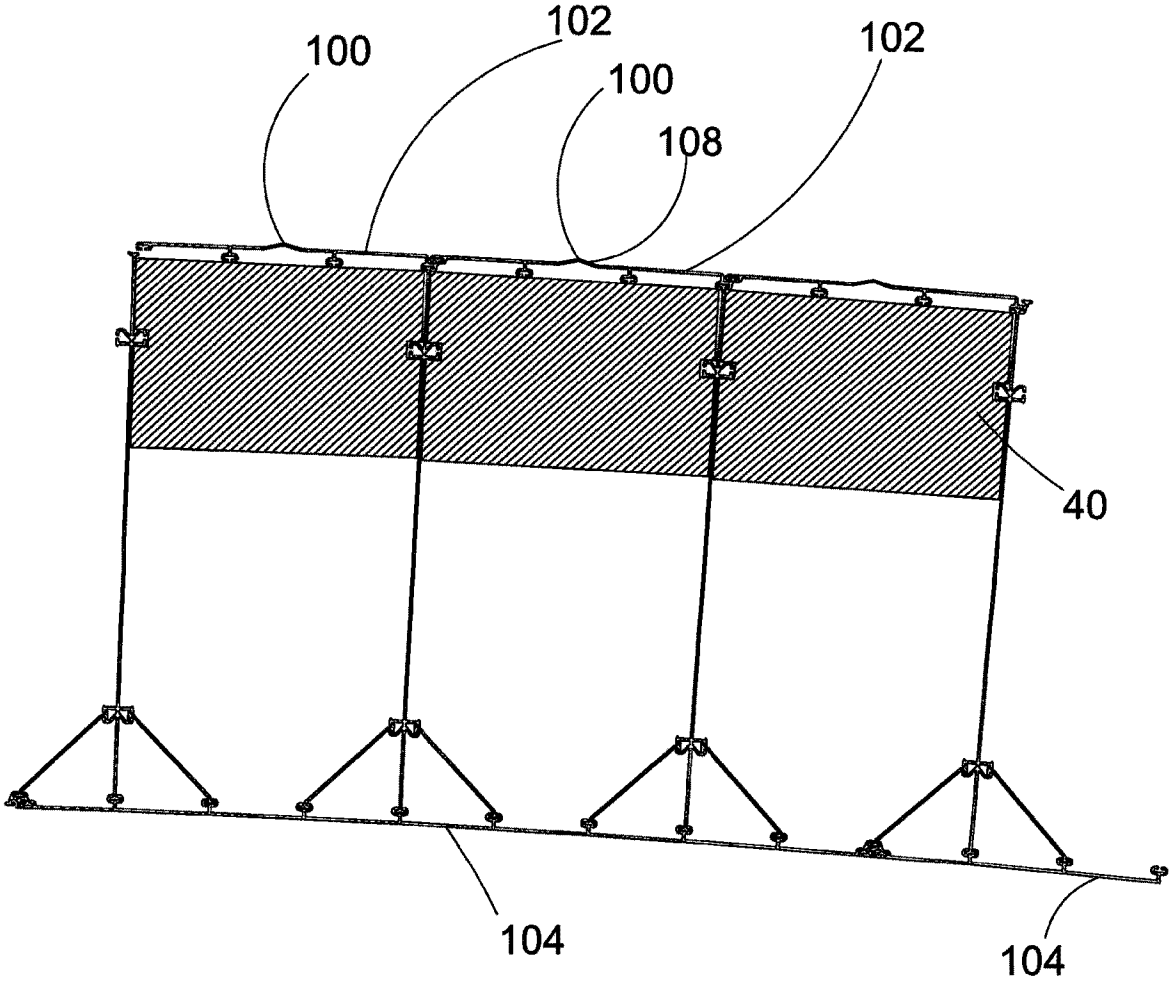
FIG. 10 shows curved formwork using the extendible panel of FIG. 9.
Figure 11:
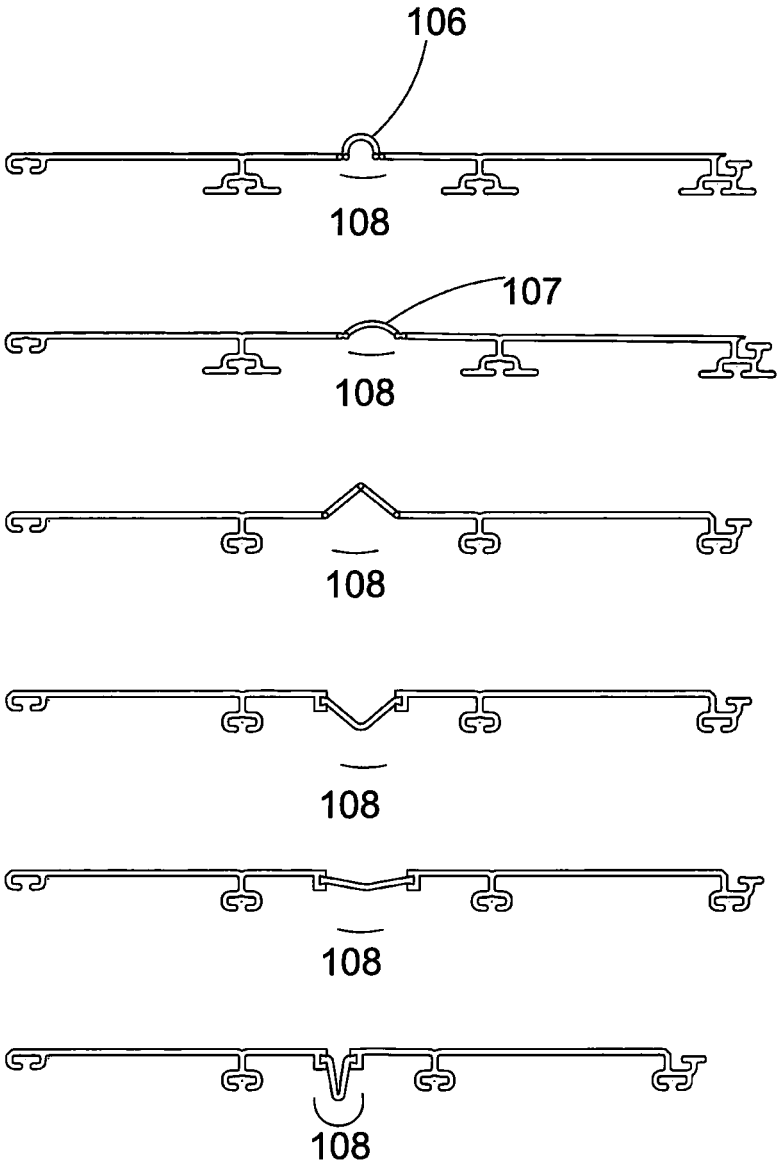
FIG. 11 comprises edge views of different suitable extendible segments in an extendible panel.

FIG. 10 shows formwork using extendible panels 102 and V-shaped notches 100 forming the outside portion of the curve of the curved formwork. Alternative shapes, including curved segments 106, 107, are shown in FIG. 11. It will be appreciated that the segment 108 in the panel may protrude inward or outward in relation to the intended formwork.

Referring again to FIG. 10, the extendible panels 102 may then be used in conjunction with panels 104 that are of the same nominal length but are not extendible, with the non-extendible panels 104 being installed on the inside of the curve. Extension of the extendible panels 102, which extension may be slight, is sufficient to accommodate the small differences in arc lengths and to avoid straining the joints of the panels and the panels themselves, and ensuring a better seal between the joints of the outside panels. It is also contemplated to use extendible panels 102 on both faces of the formwork, in which case the outside of the curve will have panels that are relatively extended in relation to the panels on the inside of the curve. The inside facing panels may simply not involve extension of the pliable segments 108, or those segments may compress if the stresses of installing the curved formwork so dictate. Providing both faces of the formwork with panels having pliable segments allows both or either one of the faces to adjust slightly in length to accommodate the curve.

In a preferred embodiment, and referring to FIG. 9, an extendible panel 102 having a horizontal extent (width) w (based on the intended orientation in use) of 6 inches may have a single pliable segment 108 in each panel having an unextended span 110 of about ½ of an inch (between straight portions 112, 114 of the panel) with the ability of the segment 108 to extend to the width of the panel by about ⅜ of an inch when stretched. It will be appreciated that the extendible panel may also in effect be contractible by providing a pliable segment 108 and may also be shortened as discussed above. In addition, more than a single pliable segment may be included.

Preferably the pliable segment 108 is made of a more flexible material than the balance of the panel. Alternatively, the segment 108 may comprise sub-segments that have the same composition as the balance of the panel, but further comprising inflexion points (for example 116, 118, 120) that are of a more pliable flexible material.

Figure 12:
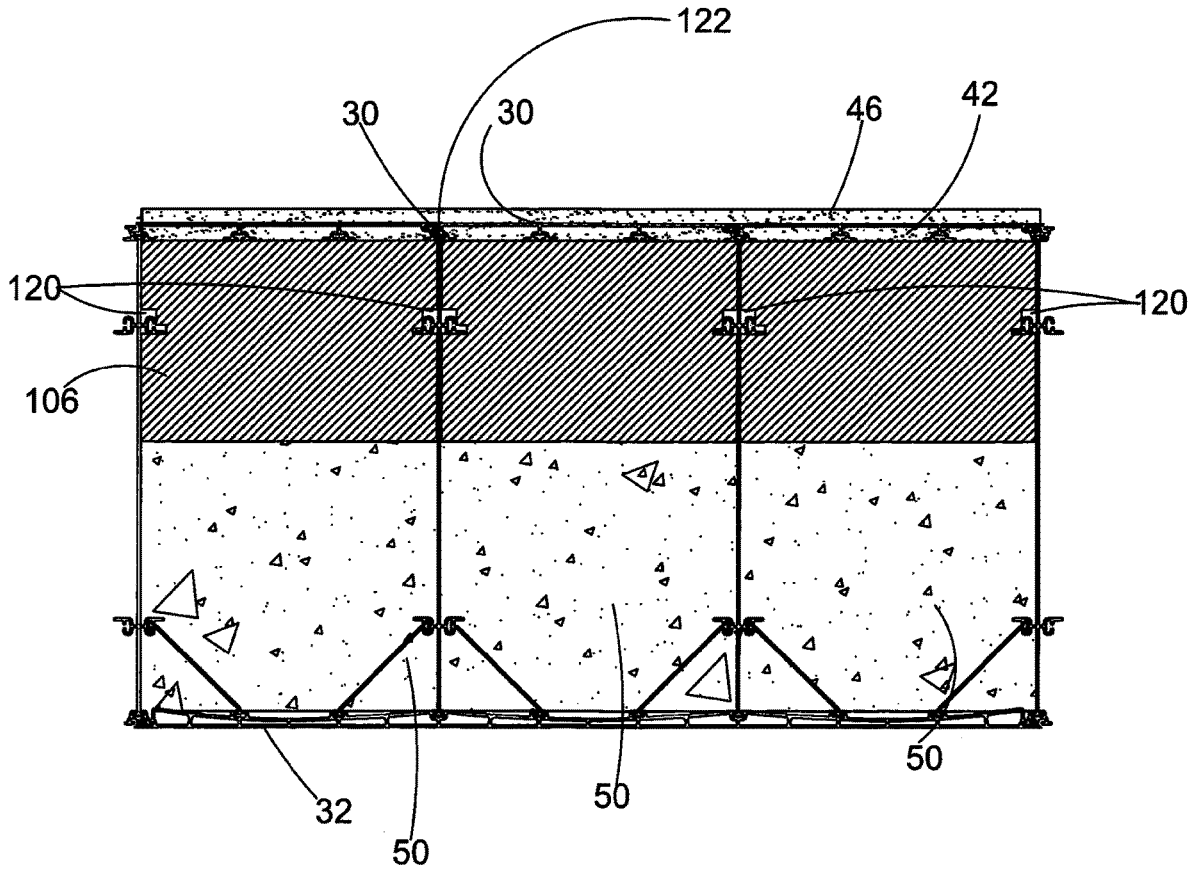
FIG. 12 is a top view of formwork according to an aspect of the invention and rigid foam insulation with cutouts for providing rainscreen functionality.
Figure 13:
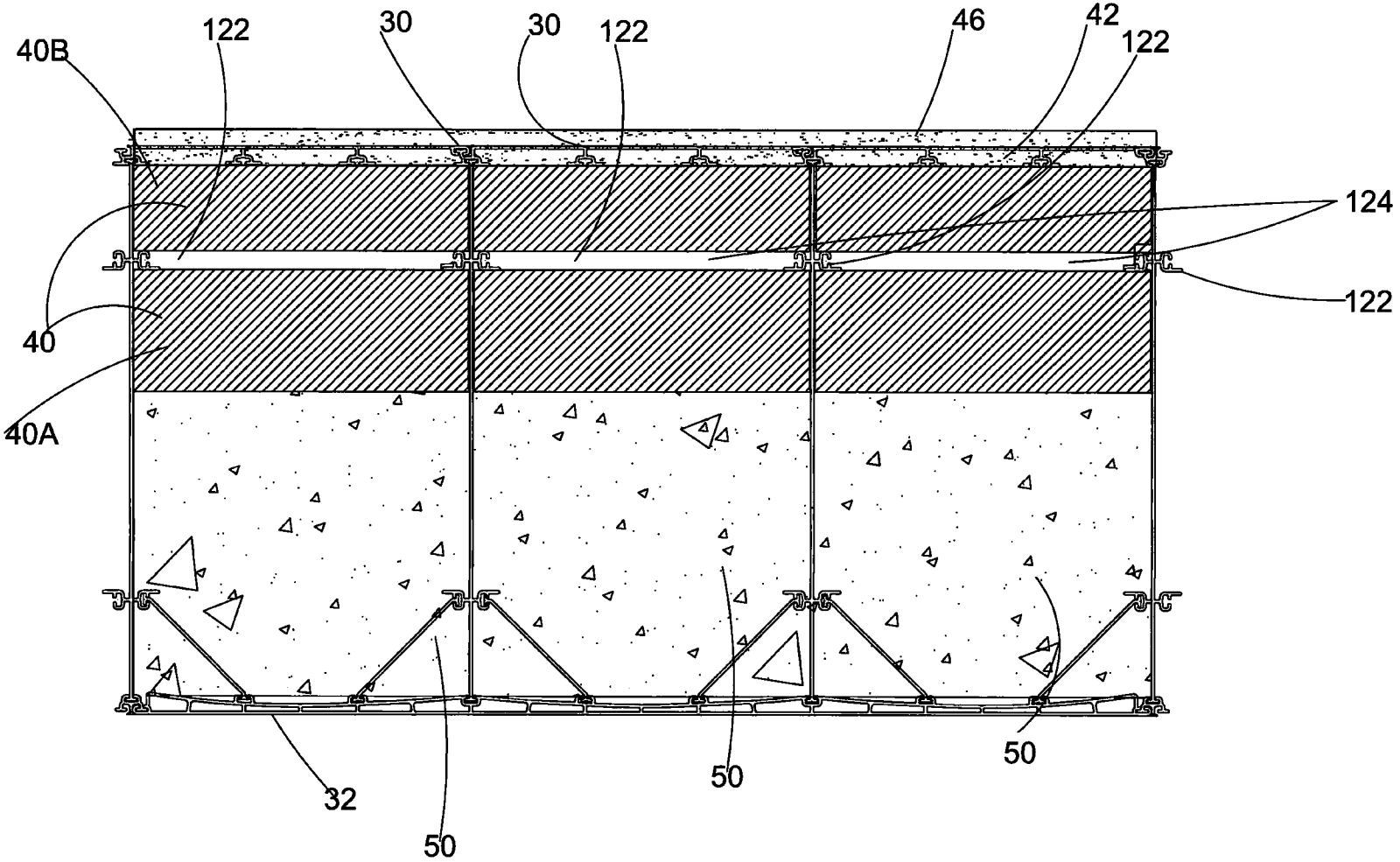
FIG. 13 is a top view of formwork according to an aspect of the invention with a space between layers of rigid foam insulation to provide rainscreen functionality.

In another aspect, and referring to FIG. 12, a rain screen capability is built into the formwork system that includes outward facing panels 30, inward facing panels 32 and transverse connectors 34. The functionality is supplied by providing rigid foam insulation 40 that includes vertical cut outs 120 providing a space surrounding mating elements or engagement members 122 on the transverse connectors 34 of the formwork. The cutouts 120 provide a vertical channel for drainage of any moisture that might migrate inward along a transverse connector 34. In an alternative shown in FIG. 13, a space 124 is provided between layers 40A and 40B of rigid insulation 40, the space 124 corresponding to the location of engagement members 122 on the transverse connectors 34.

Figure 14:
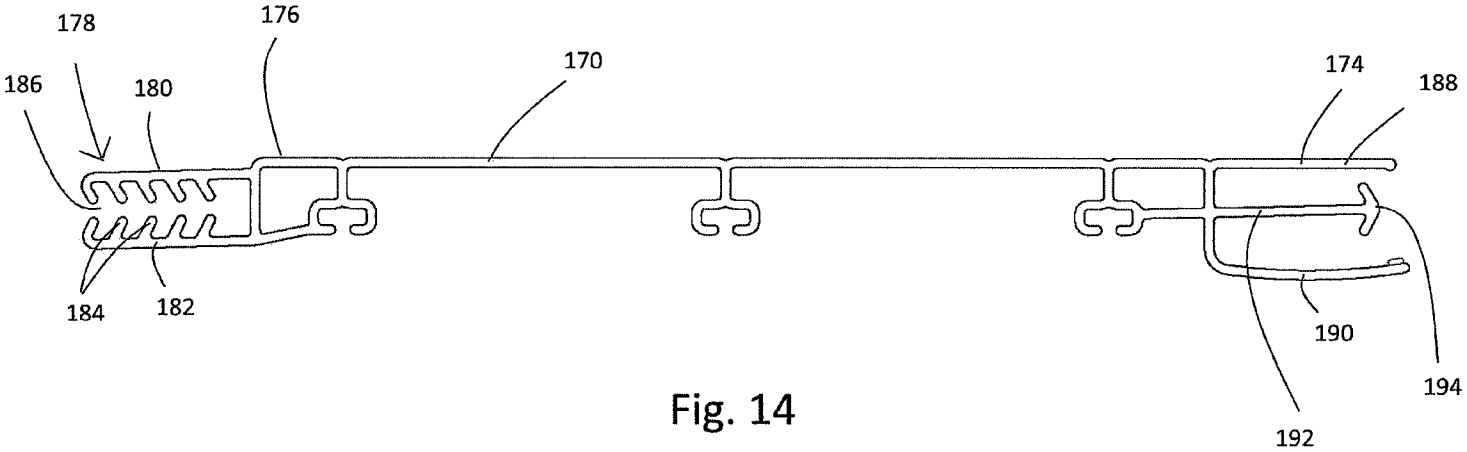
FIG. 14 is a top view of an alligator connector panel according to an embodiment.
Figure 15:
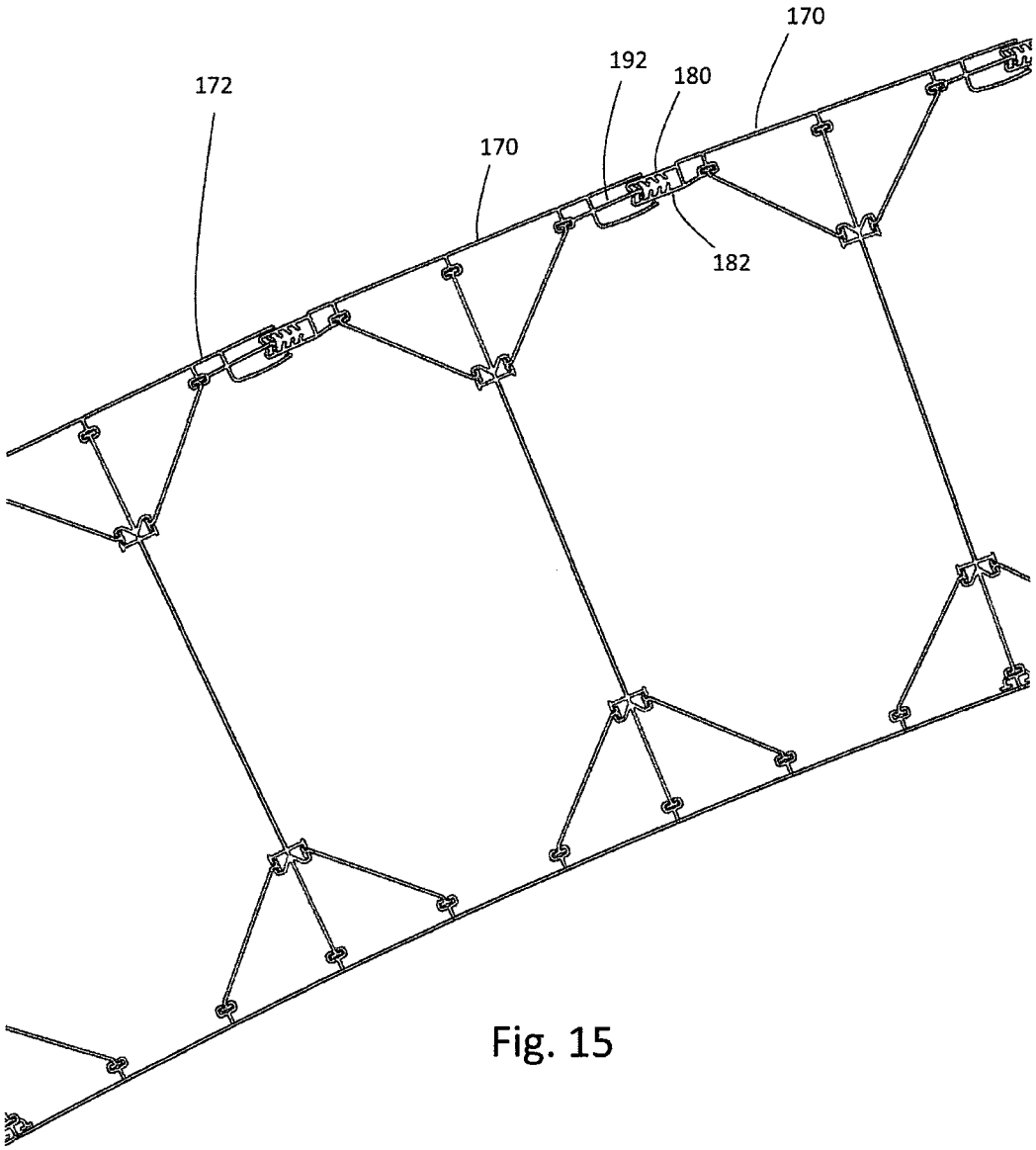
FIG. 15 is a top view of a segment of formwork for a curved structure using an alligator connector panel; and, FIG. 16 is a top view of a series of alligator connector panels showing successively tighter connections available using the alligator connector panel.

FIG. 14 is a top view of an alligator connector panel 170 according to an embodiment. As illustrated in FIG. 15, alligator connector panel 170 may be used as face panels to form an outer wall 172 of formwork of the kind generally described in this application by connecting two panels 170 end to end by means of their respective male 174 and female 176 mating ends. Female end 176 comprises a jaw 178 formed by faces 180, 182, and having successive rows of rearwardly inclined opposed teeth 184 (the teeth being ribs when considered along the length of the panel extending into the drawing). The jaw 178 defines a space 186 between the faces 180, 182.

The male end 174 of the panel comprises opposed faces 188, 190 and a stem 192 extending between the opposed faces 188, 190 and terminating in a wedge-shaped tip 194.

Figure 16:
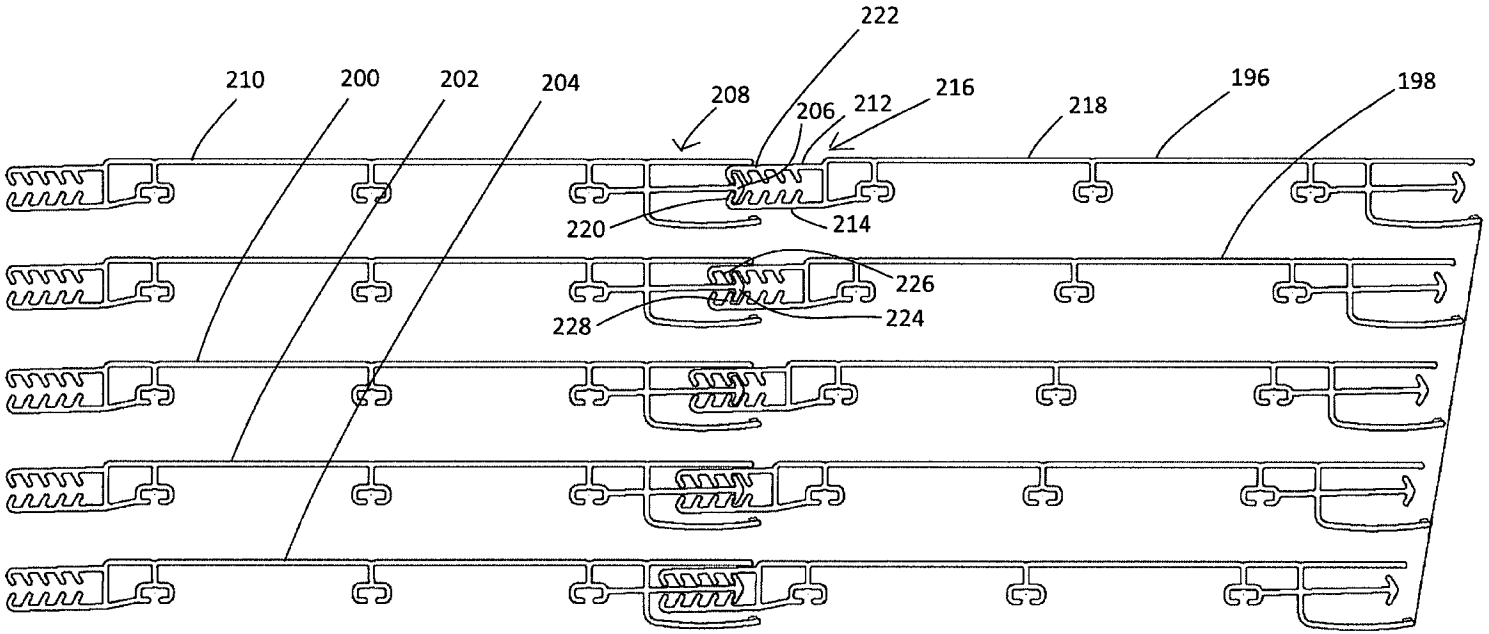

FIG. 16 illustrates the adaptability of the alligator connector panel to accommodate different intended lengths of wall. Successive examples 196, 198, 200, 202 and 204 of connections are illustrated. In example 196, tip 206 of the male end 208 of one panel 210 is engaged between opposed faces 212, 214 of the female end 216 of an adjacent panel 218. In example 196, the tip 206 is engaged between the outermost ones of opposed teeth 220, 222.

In example 198, tip 224 is engaged between opposed teeth 226, 228 that are one step inward from the outermost teeth. Successive examples 200, 202 and 204 illustrate progressively deeper engagements of the tips into the jaws of the female ends resulting in effectively shorter lengths of the connected panels.

The alligator connector panels may be used on one wall 172 of formwork to provide varying lengths of connected panels according to the depth of engagement of the tips of the male ends into the jaws of the female ends of the panels. The alligator connector panels may be used on straight walls to form both opposing walls of formwork and to adjust the overall length of the formwork to within millimeters of a desired length. In a curved wall as shown in FIG. 15, one of both walls of the formwork may comprise alligator connector panels to accommodate desired inner and outer diameters of the curved wall.

Preferably, the tips of the male ends of the alligator connector panel are made of a slightly deformable material such that when the connection between adjacent panels is under stress, such as when the interior of the formwork is filled with insulation or concrete, a seal may be formed between the tip of the male end and the teeth of the female end. Such a seal is useful in building walls and structures that must be water- or fluid-tight. Referring to FIG. 14, faces 188, 190 extend beside the stem 192 to provide further protection against the intrusion of fluid across the connection area of the panels and to facilitate guiding the male tip into the female jaw of the panels.

In the foregoing description, exemplary modes for carrying out the invention in terms of examples have been described. However, the scope of the claims should not be limited by those examples, but should be given the broadest interpretation consistent with the description as a whole. The specification and drawings are, accordingly, to be regarded in an illustrative rather than a restrictive sense.

The invention claimed is:

1. A method of using a modular panel adapted to be interconnected to other formwork panels to form stay-in-place concrete formwork to form an outward-facing wall panel of said formwork and having an outward facing substantially planar surface, wherein said modular panel has a plurality of apertures substantially throughout said surface for receiving stucco through said apertures and a plurality of projections extending inwardly from said planar surface, comprising:

assembling said stay-in-place concrete formwork;

installing rigid insulation against said projections such that a gap is formed between said rigid insulation and said modular panel;

pouring concrete into said formwork; and applying stucco to an outside side of said planar surface so that said stucco embeds into said apertures and said gap.

2. The method of claim 1, wherein said modular panel is double walled with a space between two walls.

3. The method of claim 1, wherein said step of assembling said stay-in-place concrete formwork comprises using a modular transverse connector and a three-way joining element to maintain said modular panel in an opposed spaced relationship with an opposing panel, said three-way joining element being adapted to retain said modular panel to an adjacent modular panel and to said modular transverse connector, and said three-way joining element comprising a stub extending between adjacent edges of said modular panel and said adjacent modular panel, said stub comprising an enlarged tip for engagement with said adjacent edges so as to seal the snare between them.

4. The method of claim 1, wherein said step of assembling said stay-in-place concrete formwork comprises using a modular transverse connector to maintain said modular panel in an opposed spaced relationship with an opposing panel and interconnecting said modular panel, said opposing panel, and said connector;

wherein said transverse connector comprises engagement members extending laterally from said connector;

wherein said rigid insulation has cutouts for allowing a space about said engagement members when said insulation is installed in said formwork;

and wherein said step of installing rigid insulation against said projections comprises installing said rigid insulation such that said cutouts are placed about said engagement members.

5. The method of claim 1, wherein said step of assembling said stay-in-place concrete formwork comprises using a modular transverse connector to maintain said modular panel in an opposed spaced relationship with an opposing panel and interconnecting said modular panel, said opposing, and said connector;

wherein said transverse connector comprises engagement members extending laterally from said connector;

wherein said step of installing rigid insulation against said projections comprises placing a first layer of rigid insulation on a first side of said engagement members; and wherein said method further comprises placing a second layer of rigid insulation against a second side of said engagement members so as to define a space between said first and second layers corresponding to the location of said engagement members.

6. The method of claim 1, wherein said modular panel comprises a male end and a female end;

said male end comprising a stem terminating in a wedge-shaped tip, and a face extending in spaced relationship with said stem on the inside of said modular panel and extending past said tip;

said female end having opposed faces defining a space between them and successive rows of rearwardly inclined opposed teeth depending from said opposed faces;

said male end being engageable into said female end of a same modular panel by inserting said tip for engagement between and against said opposed teeth, said tip being selectively engageable at varying depths between successive ones of said rows of teeth.

7. The method of claim 1, wherein said step of assembling said stay-in-place concrete formwork comprises using a modular transverse connector to maintain said modular panel in an opposed spaced relationship with an opposing panel;

wherein said transverse connectors comprise engagement members extending laterally from said connectors;

and wherein said engagement members comprise stems having spike for engaging into said rigid insulation.

8. The method of claim 1, wherein said step of assembling said stay-in-place concrete formwork comprises using a modular transverse connector and a three-way joining element to maintain said modular panel in an opposed spaced relationship with an opposing panel and interconnecting said modular panel, said opposing panel, and said connector;

wherein said three-way joining element has a body adapted to retain said modular panel to an adjacent modular panel and to said modular transverse connector;

and wherein said three-way joining element further comprises a T-shaped portion extending from said body, said T-shaped portion comprising a stem extending between adjacent edges of said modular panel, said adjacent panel, and two opposed arms extending from said stem.

9. The method of claim 8, wherein each of said opposed arms comprises a rib made of a softer resilient material than said body.

* * * * *